US006651818B1

(12) United States Patent
Ilmasti et al.

(10) Patent No.: US 6,651,818 B1
(45) Date of Patent: Nov. 25, 2003

(54) ION PARTICLE CLASSIFIER AND CLASSIFYING METHOD

(75) Inventors: Veikko Ilmasti, Helsinki (FI); Hannu L. Suominen, Golden, CO (US)

(73) Assignee: BCDE Group Waste Management LTD Oy, Helsinki (FI)

( * ) Notice: Subject to any disclaimer, the term of this patent is extended or adjusted under 35 U.S.C. 154(b) by 0 days.

(21) Appl. No.: 09/428,556

(22) Filed: Oct. 28, 1999

(51) Int. Cl.[7] ..... B03C 7/00
(52) U.S. Cl. ..... 209/12.2; 209/127.1
(58) Field of Search ..... 209/127.1, 127.3, 209/128, 129, 127.4, 130, 131, 12.2

(56) References Cited

U.S. PATENT DOCUMENTS

| | | | | | |
|---|---|---|---|---|---|
| 2,119,297 | A | * | 5/1938 | Scott | 95/63 |
| 2,684,760 | A | * | 7/1954 | Wintermute | 209/127.1 |
| 4,092,241 | A | * | 5/1978 | Mackenzie et al. | 209/127 A |
| 4,451,055 | A | * | 5/1984 | Urayama | 241/40 |
| 4,792,098 | A | * | 12/1988 | Haddow | 241/5 |
| 5,316,222 | A | * | 5/1994 | Kanda et al. | 241/5 |
| 5,397,066 | A | * | 3/1995 | Leitman et al. | 241/19 |
| 5,755,333 | A | * | 5/1998 | Stencel et al. | 209/127.1 |
| 6,168,029 | B1 | * | 1/2001 | Henderson et al. | 209/3 |

FOREIGN PATENT DOCUMENTS

GB 0 583 924 A2 * 8/1992 ..... B07B/7/01

OTHER PUBLICATIONS

Abstract of JP 358016117A ; "Combustion and Processing of Waste Type", Inv: Tomita et al.; Pub. Date: Jan. 29, 1983.*

* cited by examiner

*Primary Examiner*—Donald P. Walsh
*Assistant Examiner*—Joseph Rodriguez
(74) *Attorney, Agent, or Firm*—Connolly Bove Lodge & Hutz LLP

(57) ABSTRACT

The invention refers to an ion particle classifier and a method for classifying coarse solid particles from an air suspension of micronized particles, said ion particle classifier comprising a housing surrounding an electrically conductive, cylindrical inner layer, acting as a first electrode, and a centrally positioned rod with a number of radially directed lips, acting as a second electrode, said electrodes being electrically insulated from said housing and coupled to a high voltage current source, an inlet pipe for said air suspension of micronized particles to be classified terminates at a one end of said first electrode and an outlet pipe for an air suspension of classified line particles is mounted close to the opposed and of said first electrode, one end of said is provided with discharge means for a fraction of classified coarse particles of said air suspension, said classifier further being provided with a rinsing air input entering said classifier at one of its ends.

21 Claims, 3 Drawing Sheets

ION PARTICLE CLASSIFIER AND CLASSIFYING METHOD

BACKGROUND OF THE INVENTION

This invention refers to an ion particle classifier and a method for classifying coarse solid particles from an air suspension of microized particles.

All industrial fields from medical industry to mine- and building material industry use as raw materials a continuously increasing amount of different types of micronized powder like dry products. The micronizing of these products is nowadays generally carried out in jet mills, in which highly pressurized air or overheated water vapor is generally used as grinding energy. Depending on the final product and the fineness thereof the energy consumption of these grinding and classifying processes is about 100 to 3000 kWh/ton.

At this moment a micronizing technique operating according to the opposed jet mill principle is considered to be the most effective and the most economic micronizing method. However, a wider utilization and application of the developed opposed jet mill technique has been considerably disturbed by the lack of effective auxiliary techniques applicable in connection with the opposed jet mill technique and/or their low efficiency and high energy costs.

Previously known micronizing devices and methods are especially affected with the below presented basic problems and shortcomings, which undoubtedly will cause a lot of unnecessary energy consumption and will limit the quality of the final products. Said shortcomings will also considerably limit an effective realization of the basic idea of opposed jet grinding.

In micronizing a high-energy power gas, most oftenly pressurized air, is used as grinding energy. The micronizing devices will need industrial compressor effects ranging from 100 kW to 1000 kW depending upon application.

Classifying of a product micronized in an opposed jet mill as well as the methods and the devices previously used to separate power gas and solids from each other, are affected by big technical shortcomings. In the separation of solids and power gas from each other, methods and devices using different kinds of filler fabrics have been utilized, which are affected by often appearing obstruction and eillux problems, as well as of an energy consumption caused by pressure differences and, without no exception, a centrifugal fan has to be used in all applications of the separation stage in order to develop pressure differences sufficient for the operation of the device. The finer final product is to be produced, the more expensive and more difficult to control will the classifying and the separation processes turn to be. In previously used grinding processes, wherein the size of particles to be treated was more than 5 $\mu$m, such a problem did not appear.

The classifying has been based on centrifugal forces arising as a result of flow rate of a power gas and solids suspension and possibly of rate of rotation of a rotor mounted in a conventional classifying device. Control of a classifying process has been carried out by regulating the rate of rotation of said rotor as well as of the flow rate of the suspension of power gas and solids through the classifier during an initial stage of the classifying procedure, but no continuous regulation has been carried out.

It is therefore, an object of the present invention to eliminate the above drawbacks by providing a new and improved ion particle classifier.

It is another object of the present invention to provide a new and improved classifying method for separating coarse particles from an air suspension of micronized particles.

SUMMARY OF THE INVENTION

In accordance with the present invention there is provided an ion particle classifier comprising a housing surrounding an electrically conductive, cylindrical inner layer, acting as a first electrode, and a centrally positioned electrically conductive rod with a number of radially directed tips, acting as a second electrode, said electrodes being electrically insulated from said housing and coupled to a high voltage current source, an inlet pipe for said air suspension of micronized particles to be classified terminates at one end of said first electrode and an outlet pipe for an air suspension of classified fine particles is mounted close to the opposed end of said first electrode, one end of said housing is provided with discharge means for a traction of classified coarse particles of said air suspension, said classifier further being provided with a rinsing air input entering said classifier at either end of said first electrode. The classifier can be vertical or horizontal.

By means of such an ion particle classifier a very sharp and effective classifying effect is achieved when flowing an air suspension of micronized particles to be classified at a low speed through a high voltage electrical field maintained in said classifier. The ion particle classifier according to this invention is very effective and requires considerably less energy in classifying micronized solids although having very small particles size than has been possible in previously known classifying devices.

In accordance with the invention there is also provided a classifying method for separating coarse particles from an air suspension of micronized solid particles, comprising the steps of flowing said air suspension of micronized particles at a low speed up through a high voltage electric field in a classifier, between a first outer cylinder electrode and a concentrically therewith positioned second inner rod shaped electrode having a number of radially directed tips, whereby coarse particles are attracted to the inner wall of said first electrode, fall down due to force of gravity and are removed by means of discharge means, the classification being regulated by adjusting the rate of the air suspension, the voltage of the electric field as well as by adjusting solid content of the air suspension flowing through the electric field by adding rinsing air.

By means of this invention the energy economy and the efficiency of the micronizing and classifying process can be considerably improved, the environmental load can be decreased, and special products with a higher fineness than earlier can be produced, e.g. a product having a fineness of even a nano level.

Further features of the invention will appear from the attached depending claims.

DESCRIPTION OF A PREFERRED EMBODIMENT

Figure 1A:
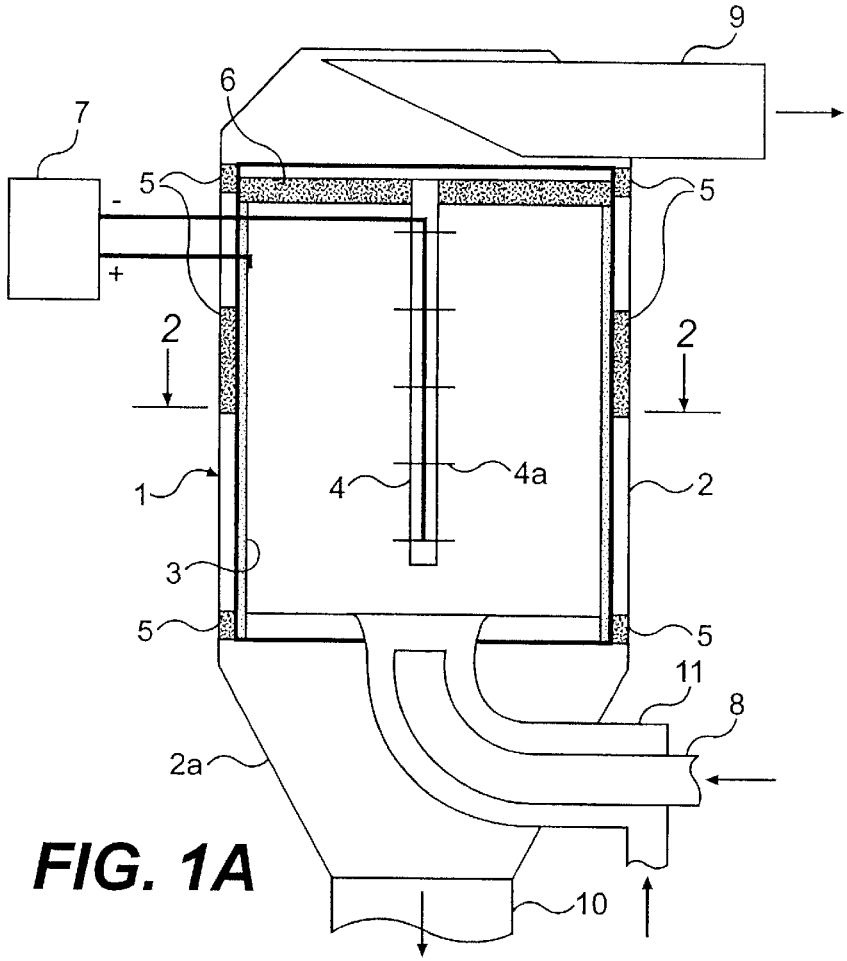
FIG. 1 is a schematical vertical sectional view of a classifier according to the present invention.
Figure 1B:
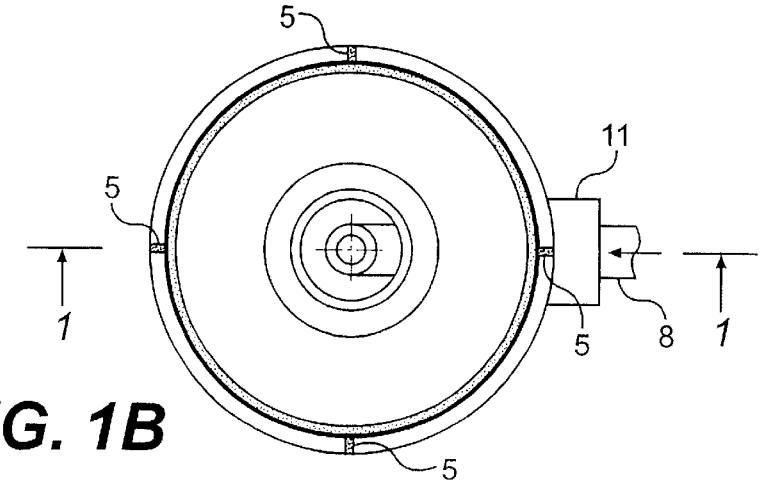

Referring now to the drawings, and more particularly to FIG. 1 thereof, there is shown an example of an ion particle classifier 1 comprising a housing 2 surrounding a vertical, electrically conductive, cylindrical inner layer 3, acting as a first electrode, and a centrally positioned electrically conductive rod 4 with a number of radially directed tips 4*a*, acting as a second electrode. Between said housing 2 and said electrodes 3, 4 there are electrical insulation means 5, 6. Said electrodes 3 and 4 are connected to a high voltage current source 7 in order to achieve a high voltage electric field between said electrodes 3, 4. An inlet pipe 8 for an air suspension of micronized particles to be classified enters the housing 2 at its bottom portion 2*a* and terminates coaxially towards said second electrode 4. An outlet pipe 9 for an air suspension of classified fine particles is mounted in the upper end of said housing 1, starting close to the upper end of the first electrode 3. The bottom portion 2*a* of said housing 2 is conically tapered and provided with discharge means 10 for a fraction of classified coarse particles of said air suspension. To improve the controllability of the classifying process the classifier 1 is further provided with a rinsing air input 11 entering said classifier 1 at the bottom portion 2*a* of the housing 2, and terminates at the lower end of said first electrode 3 coaxially towards said second electrode 4. In some cases the rinsing air can be fed into the classifier through the opposite end of the classifier.

The rinsing air input 11 is preferably mounted concentrically with the inlet pipe 8 for the air suspension of micronized particles to be classified, and thus having an annular cross section.

Air suspension of micronized solid particles to be classified is fed through the inlet pipe 8 into the classifier 1. The diameter of the first electrode 3 has such a lengths that the flowing rate of the air suspension through the classifier is about 0.5 to 1 m/s. Due to the high voltage electric field coarse between the first 3 and the tips 4*a* of the second 4 electrode solid particles of the air suspension are attracted to the inner wall of the first electrode 3. Due to force of gravity said coarse particles will fall down to the bottom portion 2*a* of the classifier 1, wherefrom they are removed by means of discharge means 10. The discharged fraction of coarse solid particles will be recycled to a micronizing step. The air suspension of classified fine particles are removed from the classifier through the outlet pipe 9 and are fed to the next treatment, such as another classifier for recovering the a further fraction of or all fine particles present in the air suspension.

The classifying process is regulated by adjusting the flow rate of the air suspension through the classifier 1 and the voltage of the electric field as well as by adjusting the solid content in said air suspension by adding rinsing air. The flow rate is regulated to be about 0.5 m/s up to about 1 m/s, which interval has proved to be most advantageous. By regulating the high voltage in the interval between about 1 kV and about 100 kV, preferably between about 5 kV and about 70 kV, the particle size of the particles in the coarse fraction, which is to be removed from the air suspension, can be varied very easily. In order to receive an optimal content of solid particles in the air suspension fed to the classifier and to regulate the flow rate, an adjustable amount of rinsing air is fed to the classifier 1 together with the air suspension of particles to be classified.

By feeding the rinsing air into the classifier 1 through an annular inlet pipe 11, surrounding the inlet pipe 8 for the air suspension of micronized particles to be classified, a most advantageous mixture of the rinsing air and the air suspension is received.

Figure 3:
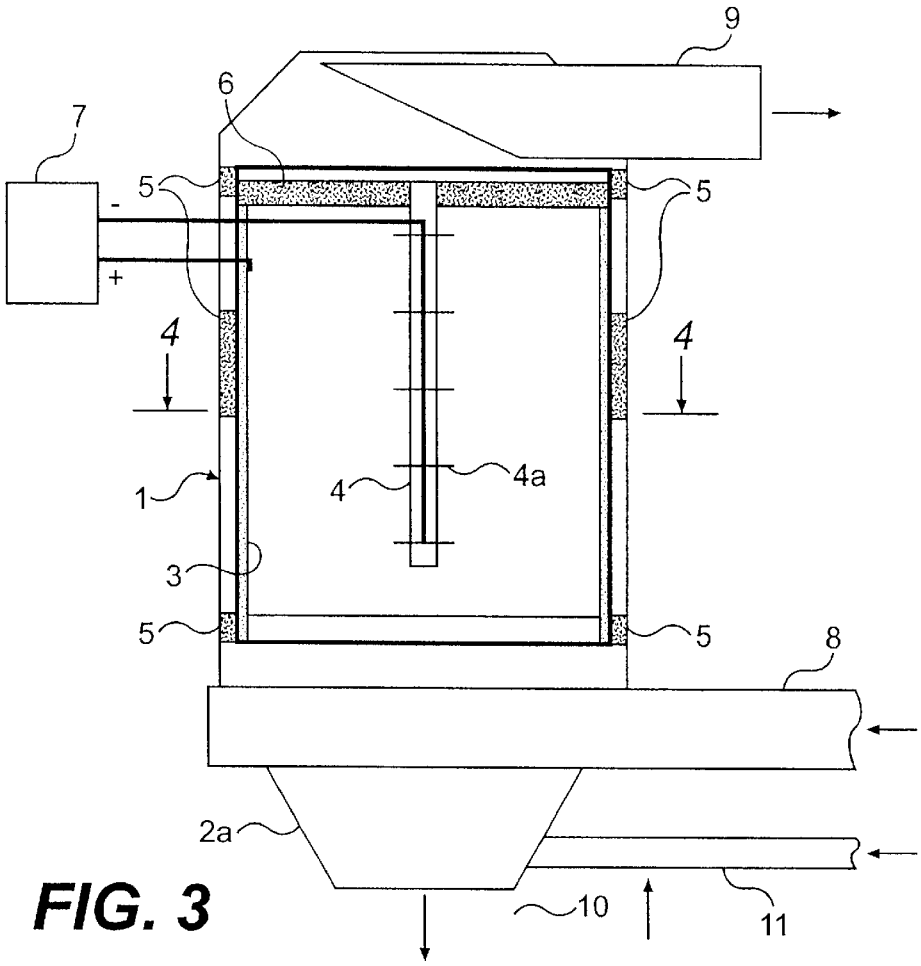
FIG. 3 is a schematical vertical sectional view of another embodiment of the ion particle classifier according to the invention.
Figure 4:
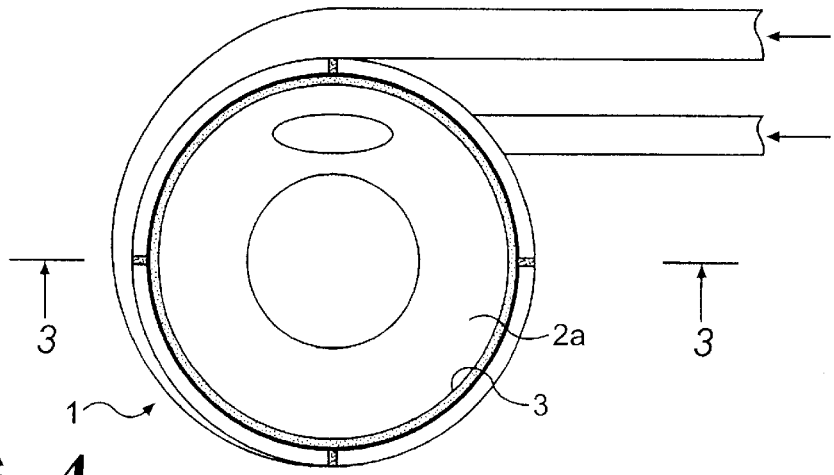
FIG. 4 is section B—B of FIG. 3.

Referring to FIG. 3 and FIG. 4, there is shown another embodiment of the ion particle classifier according to the invention. The inlet pipe 8 for an air suspension of micronized solid particles to be classified enters the bottom portion 2*a* of the classifier 1 tangentially and the rinsing air input 11 enters the classifier at a lower level and terminates coaxially or tangentially with the second electrode 4 as in the previous embodiment. By this embodiment the lower end of the classifier will act as a cyclone separating the coarsest particles from the air suspension before it reaches the high voltage electric field between the electrodes 3 and 4.

Figure 2:
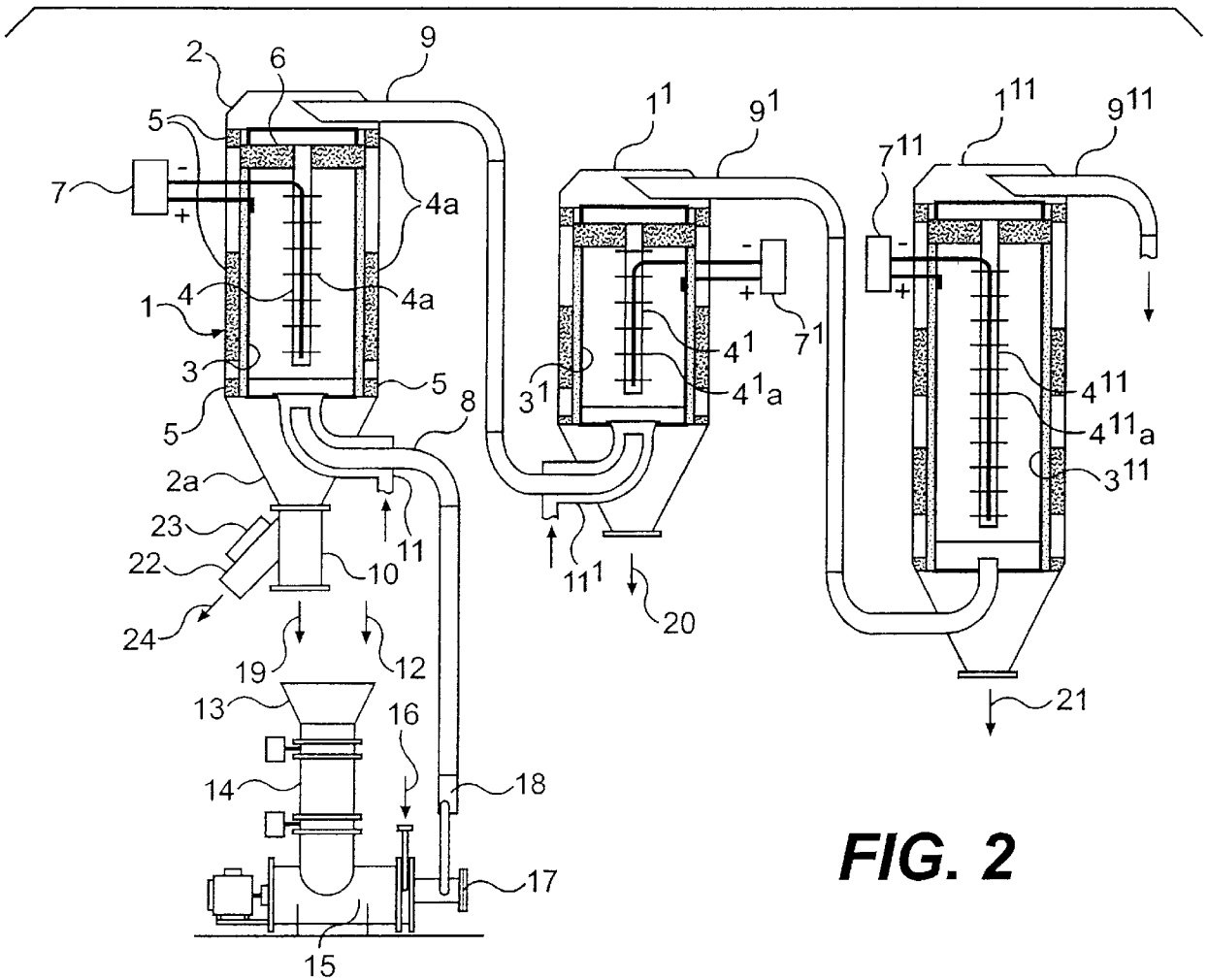
FIG. 2 is a schematical vertical sectional view of a micronizing equipment including three somewhat different ion particle classifiers according to this invention coupled in series to each others.

Referring now to FIG. 2, there is shown a preferred embodiment of a micronizing equipment comprising ion particle classifiers according to the invention. Material to be microinzed is fed, as illustrated by arrow 12, to a supply hopper 13 at the top of a double valve feeder 14 operating as a feeder device of an equalizing tank 15 of an opposed jet mill. From the supply hopper the material is fed by means of the double valve feeder 14 in portions to the equalizing tank 15, wherein a static pressure required for the micronizing is maintained. By means of a screw feeder or a rotor the material is transposed from the equalizing tank 15 into a flowing, high-energy power gas, preferably air, as illustrated by arrow 16 in order to form an air suspension of the solid particles. The air suspension of the solid particles is led through a dividing device 17 and at least two substantially opposed directed acceleration nozzles into a small grinding chamber 18, wherein the particles to be ground collide against one another and are crushed/micronized almost autogenically. The grinding chamber 18 is preferably of a type as described in our copending U.S. patent application. The discharge opening of the grinding chamber 18 is connected to a first ion particle classifier 1 through an inlet pipe 8 for an air suspension of micronized solid particles to be micronized. This first ion particle classifier 1 is similar to that shown in FIG. 1, and acts as described above. In the ion particle classifier 3 the micronized material is classified by means of the high voltage electric field into a fine fraction and a coarse fraction. The coarse fraction is removed through a discharge device 10 mounted at a bottom end of said classifier 1. In the shown embodiment the coarse fraction is recycled to the hopper 13 of the opposed jet mill, as indicated by arrow 19 for regrinding, but in some cases the coarse fraction can be recovered as a separate final product. The fine fraction is discharged as an air suspension of those classified fine particles through the outlet pipe 9 mounted at the top of the classifier 1. The air suspension of fine particles is led through the outlet pipe 9 into a second ion particle classifier 1'. In said second classifier 1', a first final product is separating from the air suspension of classified fine particles by means of a high voltage electric field achieved by a high voltage current source 7' between the electrodes 3' and 4' in said second classifier 1'. If necessary rinsing air is fed to the second classifier 1' through input 11'. The first final product is discharged from the bottom of said second classifier 1', as indicated with arrow 20. The remaining air suspension of the classified finest solid particles is fed through a second outlet pipe 9' to a final ion particle classifier 1", wherein all remaining solid particles are separated from the air by means of a third high voltage electric field between electrodes 3", and 4" achieved by a third high voltage current source 7", and are recovered as a second, extremely fine final product, as indicated by arrow 21. Often a very valuable solid material, having a nano level fineness, can be recovered from the final classifier 1". The purified air is removed from the final classifier 1" through outlet pipe 9". This purified air can be fed directly to the atmosphere or be recycled to a compressor to pressurize power gas for the micronizing process. By using a micronizing equipment according to this invention there will be no environmental load.

By means of the present invention ultra fine powders can be produced considerably more effectively and economically than before from different dry and moist raw materials, when the final products have a D98 particle size of 3,3 μm to 150 μm, and an average or D60 particle size of 0,01 μm to 30 μm.

The developed equipment and method can very well be used in separating, enriching and dry enriching of different types of e.g. minerals, metals and organic materials as well as in the production of crystal seed used by different industrial areas. The method will also make it possible to produce final products having a finer particles size than previously, i.e. at the nano level from solid raw materials.

According to a preferred embodiment the micronizing equipment is used in recovering carbon from used car tires. The used car tires are pyrolized, the steel is separated from the pyrolized carbon using a magnet separator. The pyrolized substantially steel free carbon is fed to the supply hopper 13 of the micronizing equipment. The coarse fraction, separated from the air suspension in the first classifier is discharged from the first classifier by means of the discharge means 10 provided with a branch pipe 22 having a magnetic separator 23 influencing possibly present steel particles in the coarse fraction to deviate into said branch pipe in order to be recovered, as indicated with arrow 24. The coarse carbon fraction is recycled to the micronizing device, as indicated with arrow 19. From the second ion particle classifier 1', and first final product of micronized carbon will be recovered by means of a discharge means, such as a lock feeder or a double valve feeder. Said first final product can be used as raw material in producing new car tires. The extremely fine solid fraction recovered from the final ion particle classifier, as indicated by arrow 21 can be used as pigment for instance in producing black plastic foils.

What is claimed is:

1. Ion particle classifier comprising:

a housing surrounding an electrically conductive, cylindrical electrode, and a rod electrode centrally positioned with respect to the cylindrical electrode with a number of radially directed tips, wherein said cylindrical and said rod electrode are electrically insulated from said housing and coupled to a high voltage current source;

an inlet pipe for directing an air suspension of mixed micronized particles to be separated into course and fine particles, wherein said inlet pipe is disposed at a lower end of said cylindrical electrode and terminates coaxially with said rod electrode;

an outlet pipe disposed at an upper end of said cylindrical electrode for the removal of fine particles; a discharge outlet for the removal of coarse particles; and a rinsing air input disposed at the lower end or the upper end of said cylindrical inner electrode.

2. Ion particle classifier according to claim 1, wherein said rinsing air input terminates concentrically with said inlet pipe to adjust solid content in the classifier.

3. Ion particle classifier according to claim 1, wherein said rinsing air input terminates coaxially with said rod electrode.

4. Ion particle classifier according to claim 1, wherein said discharge outlet comprises a branch pipe provided with a magnetic separator for separating magnetic particles from the removed coarse particle.

5. Ion particle classifier according to claim 1, wherein said inlet pipe is connected to a discharge pipe of an opposed jet mill.

6. Ion particle classifier according to claim 5, wherein the outlet pipe for the removal of fine particles is directed to a second ion particle classifier for additional classification of particles.

7. Ion particle classifier according to claim 6, wherein said second ion particle classifier is connected in series to at least a third ion particle classifier.

8. A method for separating coarse particles from an air suspension of mixed particles comprising:

directing said air suspension of mixed particles via an inlet pipe to a classifier with a high voltage electric field, wherein the electric field is generated with an outer cylindrical electrode and a concentrically therewith positioned inner rod electrode having a number of radially directed tips, the inlet pipe terminating coaxially with the rod electrode, whereby coarse particles are attracted to the inner wall of said outer cylindrical and fall due to gravity through a discharge outlet; and adjusting one or more separation parameters selected from the group consisting of the rate of said air suspension of mixed particles, the magnitude of the electric field, and the solid content of the air suspension by adding air from a rinsing air input.

9. A method according to claim 8, wherein the air suspension of mixed particles is fed coaxially towards said inner rod electrode, whereby coarse particles are attracted to the outer cylindrical electrode and fall to the discharge outlet of the classifier, and fine particles will pass through the classifier and exit an upper end of the classifier.

10. A method according to claim 9, wherein the air from the rinsing air input is fed to the classifier concentrically with the air suspension of mixed particles.

11. A method according to claim 9, wherein the air from the rinsing air input is fed from the upper end of the classifier and the air suspension of mixed particles is fed from the lower end the classifier, the lower end defined by the direction the coarse particles fall due to gravity.

12. A method according to claim 8, wherein the air suspension of mixed particles is fed tangentially into a lower end of the classifier, the lower end defined by the direction the coarse particles fall due to gravity.

13. A method according to claim 8, wherein a voltage difference of 1 kV to 100 kV is applied to the electrodes to generate the electric field.

14. Classifying method according to claim 13, wherein the voltage difference applied to the electrodes is 5 kV to 70 kV.

15. A method according to claim 8, wherein the air suspension of mixed particles were micronized in an opposed jet mill and a fraction of the removed coarse particles are directed back to said opposed jet mill.

16. A method according to claim 15, wherein said mixed particles originate from used car tires.

17. A method according to claim 15, wherein the fine particles are removed from an upper end of the classifier and directed to a second classifier.

18. Classifying method according to claim 15, wherein the air suspension of classified fine particles from the first classifier is fed in series to at least two further classifiers whereby the voltage and the speed of the air stream through the final classifier is regulated to remove all particles from the air suspension.

19. The method of claim 8 wherein directing said air suspension of mixed particles includes directing said particles at a speed of about 0.5 m/s to about 1 m/s.

20. The method of claim 8 wherein said mixed particles is a material selected from the group consisting of minerals, metals, and organics.

21. The method of claim 8 wherein said mixed particles comprise pyrolized carbon particles from used car tires.

* * * * *